United States Patent [19]

Huang et al.

[11] 4,255,615

[45] Mar. 10, 1981

[54] DIELECTRIC CORONA RINGS

[75] Inventors: Kwang T. Huang, Port Hueneme; Brian R. Milner, Camarillo, both of Calif.

[73] Assignee: The United States of America as represented by the Secretary of the Navy, Washington, D.C.

[21] Appl. No.: 78,257

[22] Filed: Sep. 24, 1979

[51] Int. Cl.[3] ..... H01B 17/44

[52] U.S. Cl. ..... 174/140 CR; 174/144

[58] Field of Search ..... 174/127, 140 R, 140 H, 174/140 S, 140 CR, 141 R, 141 C, 144

[56] References Cited

U.S. PATENT DOCUMENTS 3,515,909 6/1970 Trump ..... 174/127 X

FOREIGN PATENT DOCUMENTS 44-29710 12/1969 Japan ..... 174/144

113991 3/1926 Switzerland ..... 174/140 R

*Primary Examiner*—Laramie E. Askin

*Attorney, Agent, or Firm*—Richard S. Sciascia; Joseph M. St. Amand

[57] ABSTRACT

A dielectric corona ring to provide field shaping by spreading or deconcentrating an electric field for reduction or elimination of ionization of air near a high voltage insulator.

3 Claims, 7 Drawing Figures

DIELECTRIC CORONA RINGS

BACKGROUND OF THE INVENTION

Electrical conductors at high voltage are surrounded by electric fields that are more concentrated, i.e., have higher voltage gradients, in the vicinity of sharp points or small radii of curvature of electrodes, terminals, or conductive components of the circuit. If the voltage gradient is high enough, the air surrounding these points will be ionized, and a corona discharge will develop which may lead to a flashing spark or arc discharge to another conductor at a different potential. The use of toroidal metallic corona rings around these vulnerable points in order to minimize electrical discharging is common practice. However, the metal corona rings frequently are insufficient to prevent flash discharging. This invention uses dielectric corona rings to provide a significant improvement over the prior metal type corona rings, and thus increase the insulating capability of high voltage insulators.

DESCRIPTION OF THE PREFERRED EMBODIMENT

Figure 1:
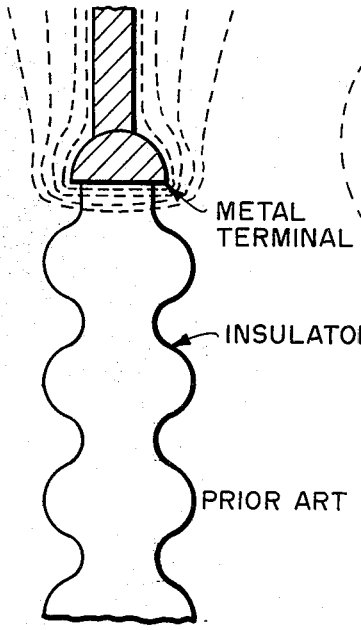
FIG. 1 shows the electric field about a high voltage insulator without any corona ring.
Figure 2:
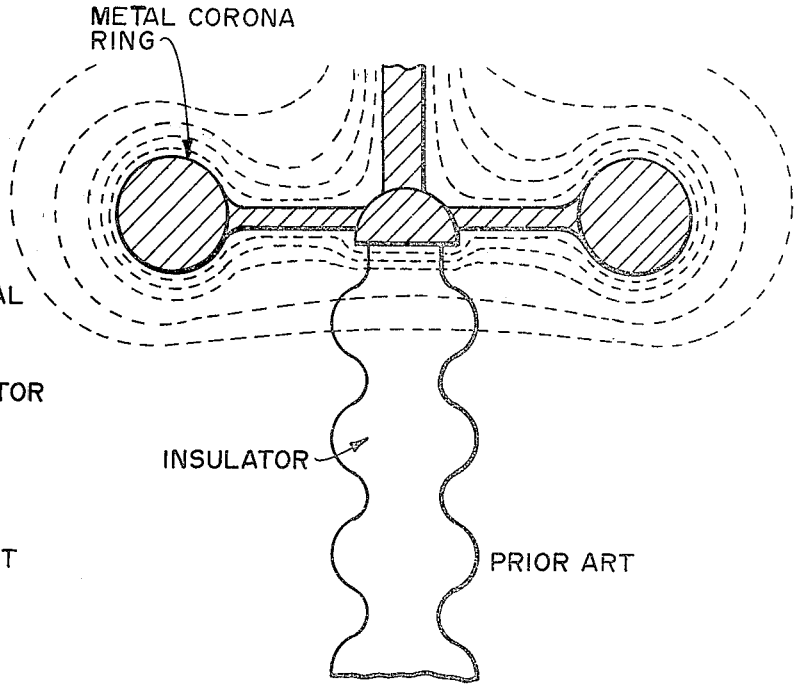
FIG. 2 shows the electric field about a high voltage insulator with a metal corona ring.

A high voltage insulator without the protection of corona rings may be surrounded by an electric field such as shown in FIG. 1. The equipotential lines of FIG. 1 show that the field is concentrated, having a high voltage gradient, in the vicinity of the relatively sharp shoulder of the terminal cap. It is here that corona and flash discharges are most likely to occur. Metallic corona rings, as commonly used with high voltage equipment may develop an electric field as shown in FIG. 2 where the concentration of the electric field is somewhat reduced and consequently, the likelihood of corona or flash discharging is also reduced. The present invention however, uses dielectric corona rings. A dielectric material, with a much higher dielectric constant than air is used; the dielectric corona rings have a much lower voltage gradient in a given electric field, which in turn tends to spread or deconcentrate the electric field in the dielectric.

Figure 3:
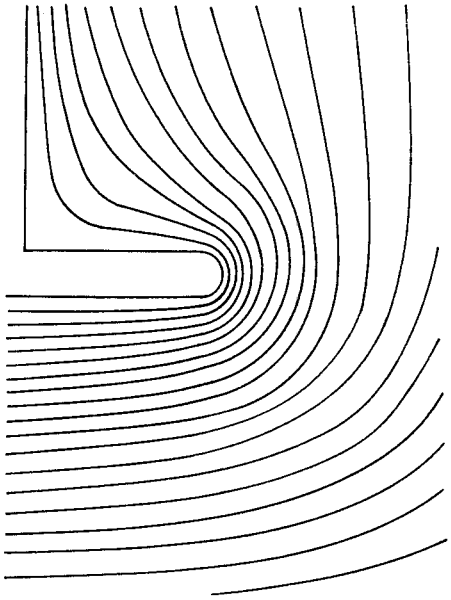
FIG. 3 shows a computer drawing of the equipotential lines of an electric field around (one-half) a metal corona ring or disc.
Figure 4:
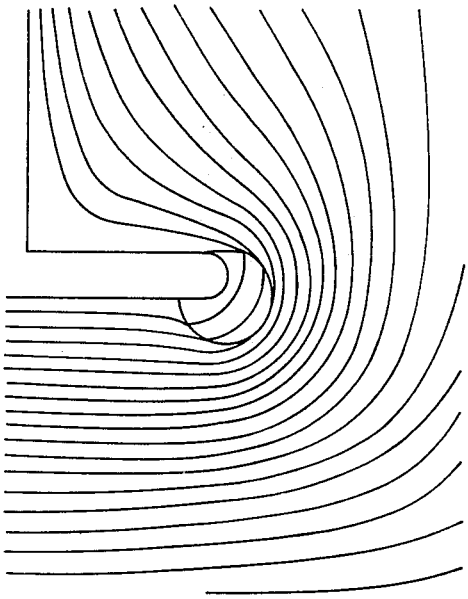
FIG. 4 shows a computer drawing of equipotential lines of an electric field around (one-half) a dielectric corona ring on a metal support.

By comparing the computer drawing of FIG. 3 showing equipotential lines of an electric field around a metal corona ring with the computer drawing of FIG. 4 showing equipotential lines of electric field around a dielectric corona ring on a metal support, it can readily be seen that use of a dielectric corona ring very greatly reduces the concentration of the electric field in the vicinity of the metal parts, and thus there is less likelihood of corona or flash discharges to occur; the lower voltage gradient produces less ionization of the air adjacent to the metallic parts. The insulating capability of the high voltage insulators is significantly increased with the use of the dielectric corona rings of this invention.

Figure 5:
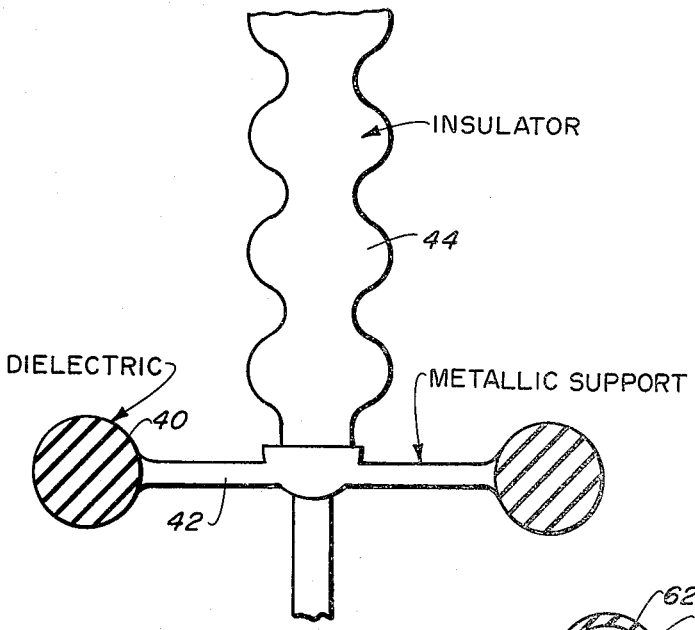
FIG. 5 shows in one embodiment of the invention, a solid dielectric corona ring, in cross-section, on a metal support about a high voltage insulator.
Figure 6:
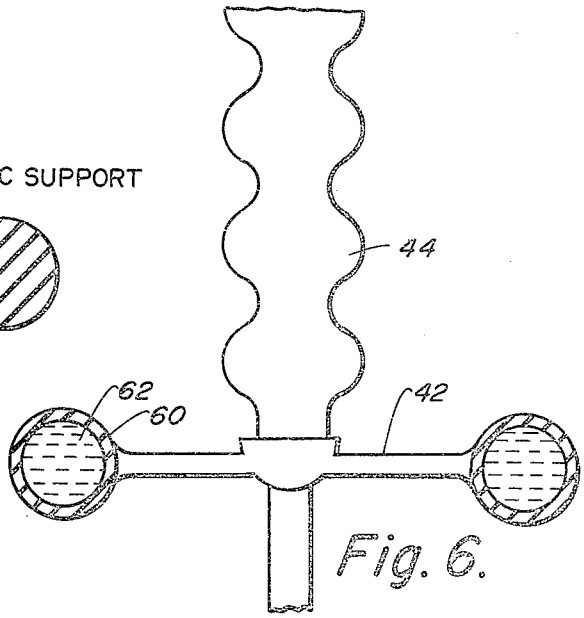
FIG. 6 shows in another embodiment of the invention, a dielectric fluid filled corona ring, in cross-section, on a metal support about a high voltage insulator.

The dielectric corona rings can be made from porcelain or other suitable high dielectric material having a dielectric constant of 10 or more. A toroid 40, such as shown in FIG. 5, and made from such high dielectric material can be mounted on metal supports 42 about the end of an insulator 44. The toroid is usually of solid dielectric material. However, a rigid hollow dielectric toroid 60, as shown in FIG. 6, filled with a fluid dielectric 62, such as transformer oil, can be used in place of the solid toroid shown in FIG. 5 and will operate very satisfactorily.

The dielectric ring can replace a metal corona ring for reduced weight as well as to reduce field intensity, or a dielectric ring as disclosed herein can be added over an existing metal ring to reduce the field intensity/voltage gradient in the area of the ring.

Figure 7:
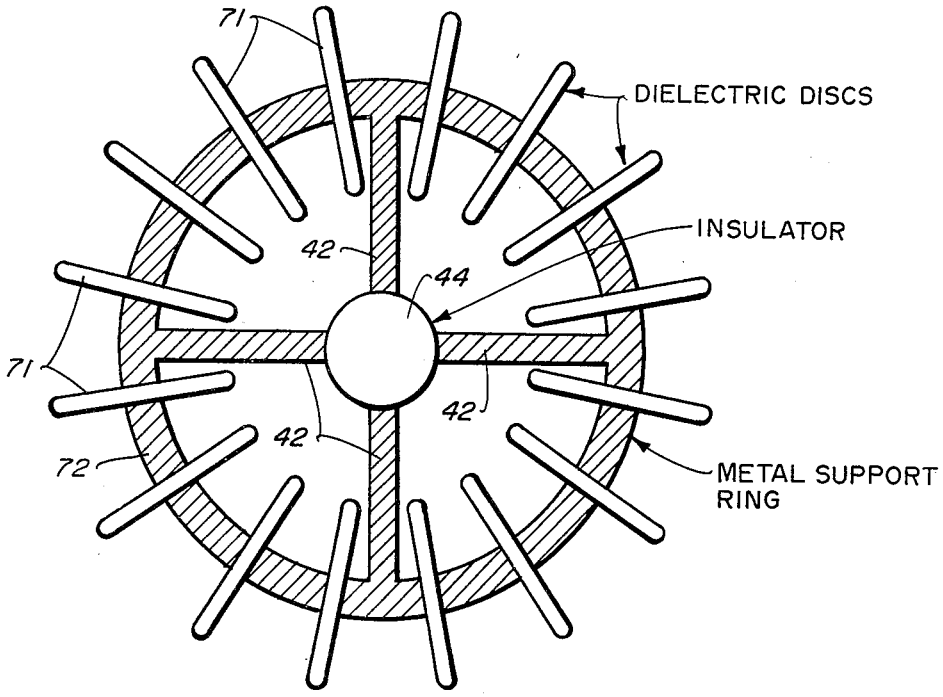
FIG. 7 illustrates still another embodiment of the invention using dielectric discs on a metal support ring about a high voltage insulator.

Another form of this invention uses dielectric discs of substantially greater diameter than the tickness of the supporting metallic ring 72 on which the dielectric discs are mounted, as shown in FIG. 7. Depending on the closeness of the spacing of the discs, the resulting field will resemble that shown in FIG. 4 for the solid or filled dielectric toroidal rings. Since the field will tend to move toward the metal support ring in the spaces between discs as the discs are mounted farther apart, this alternative represents a modification of the basic invention as a trade-off between field improvement and reduction in weight and mechanical loading with large suspension insulators. If desired, the dielectric discs can be added to metal toroid rings on high voltage insulators already in use by any well-known or suitable means, such as "split washer" type flexible dielectric discs, for example, which can be snapped onto the toroid rings.

The dielectric corona rings of this invention represent a great improvement over metal corona rings. They reduce the concentration of the electric field in the vicinity of the metal parts and the likelihood of corona or flash discharging.

Obviously many modifications and variations of the present invention are possible in the light of the above teachings. It is therefore to be understood that within the scope of the appended claims the invention may be practiced otherwise than as specifically described.

What is claimed is:

1. A corona ring in combination with a high voltage insulator, comprising:

a. a high voltage insulator means;

b. a metallic support means mounted about said high voltage insulator means;

c. a corona ring formed from a metallic toroid mounted on said support means for surrounding said high voltage insulator means;

d. said toroid having a plurality of spaced apart dielectric discs of substantially greater diameter than the thickness of said toroid mounted thereon about the circumference thereof; the electric field about the corona ring being operable to be vared by varying the number of and the spacing between said dielectric discs, the electric field tending to move toward said toroid ring when the spacing between said dielectric discs is increased;

e. said corona ring and dielectric discs operating to spread and deconcentrate an electric field in and near the corona ring about said high voltage insulator and reduce the likelihood of corona and flash discharging.

2. A device as in claim 1 wherein said metallic support means is a metallic disc about an end of said high voltage insulator.

3. A device as in claim 1 wherein said metallic support means is a metallic spoke arrangement about said high voltage insulator.

* * * * *